US011993440B2

(12) United States Patent
Beck et al.

(10) Patent No.: US 11,993,440 B2
(45) Date of Patent: May 28, 2024

(54) ARTICLE HANGER, SALES PRODUCTS AND PRODUCTION METHOD

(71) Applicant: Hilti Aktiengesellschaft, Schaan (LI)

(72) Inventors: Helmut Beck, Triesenberg (LI); Cornelius Linder, Bregenz (AT); Hans Rusch, Balzers (LI); Florian Schroeder, Maienfeld (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 18/225,418

(22) Filed: Jul. 24, 2023

(65) Prior Publication Data

US 2024/0034534 A1 Feb. 1, 2024

(30) Foreign Application Priority Data

Jul. 27, 2022 (EP) ..... 22187119

(51) Int. Cl.
*B65D 85/20* (2006.01)
*B25H 3/00* (2006.01)
(Continued)

(52) U.S. Cl.
CPC ..... *B65D 73/0064* (2013.01); *B65B 5/04* (2013.01); *B65D 65/466* (2013.01); *B65D 85/20* (2013.01); *B65B 15/00* (2013.01); *B65D 85/28* (2013.01)

(58) Field of Classification Search
CPC ..... B65B 5/04; B65D 23/003; B65D 23/005; B65D 35/245; B65D 65/466; B65D 73/0064; B65D 73/0042; B65D 73/007; B65D 75/02; B65D 75/06; B65D 85/20; B65D 85/24; B65D 85/26; B65D 85/28; B65D 73/00; B25H 3/003; B25H 3/04; A47F 7/0021; A47F 5/0006; A47F 5/0869
(Continued)

(56) References Cited

U.S. PATENT DOCUMENTS 1,967,992 A * 7/1934 Ellstrom ..... B65D 5/5028 229/93
3,023,925 A * 3/1962 Sher ..... B65D 39/14 29/451
(Continued)

FOREIGN PATENT DOCUMENTS

WO WO 9930982 A1 6/1999
WO WO 2020/117420 A1 6/2020
WO WO 2023/099216 A1 6/2023

OTHER PUBLICATIONS

European Patent Office, Extended European Search Report in corresponding European Application No. 22 187 119.7.

*Primary Examiner* — Gideon R Weinerth
(74) *Attorney, Agent, or Firm* — Leydig, Voit & Mayer, Ltd.

(57) ABSTRACT

The invention relates to an article hanger having a receiving region, wherein, by means of the receiving region, a receiving space for receiving an article of at least one article type, for example at least one type of tool for a mobile machine tool or at least one type of building product, is formed in the interior of the receiving space. The receiving region is formed from a wound tube and/or comprises a wound tube. An environmentally friendly material can be used as the raw material for the wound tube. Risks to the environment as a result of carelessly discarded article hangers can therefore be avoided or at least reduced.

13 Claims, 2 Drawing Sheets

(51) Int. Cl.

| | |
|---|---|
| ***B65B 5/04*** | (2006.01) |
| ***B65D 65/46*** | (2006.01) |
| ***B65D 73/00*** | (2006.01) |
| *B65B 15/00* | (2006.01) |
| *B65D 85/28* | (2006.01) |

(58) Field of Classification Search
USPC ..... 206/338, 806, 206, 349, 495; 211/69; 248/686; D9/414, 415
See application file for complete search history.

(56) References Cited

U.S. PATENT DOCUMENTS 3,532,130 A * 10/1970 Brooking ..... F16L 9/16 229/93
3,885,667 A * 5/1975 Spiegel ..... B65D 75/54 206/466
3,978,984 A * 9/1976 Cowley ..... B65D 73/0007 206/443
4,339,885 A * 7/1982 Brown ..... G09F 3/00 40/309
4,877,135 A * 10/1989 Gabriel ..... F16B 15/08 206/338
4,909,386 A * 3/1990 Jeffers ..... B25H 3/003 206/379
D320,159 S * 9/1991 Wallach ..... D9/415
5,477,964 A * 12/1995 Hart ..... B65D 73/0021 206/483
5,484,056 A * 1/1996 Wood ..... B65D 73/0064 206/349
D376,312 S * 12/1996 Cahn ..... D9/415
5,979,649 A * 11/1999 Rosler ..... B65D 25/10 206/349
5,979,652 A * 11/1999 Rosler ..... B65D 73/0064 206/349
D420,577 S * 2/2000 Steel ..... D9/415
D431,460 S * 10/2000 Nichol ..... D9/415
6,401,924 B1 6/2002 Fresnel
6,540,073 B1 * 4/2003 Hagel ..... B65D 75/305 206/467
D495,596 S * 9/2004 Trettin ..... D9/415
D497,105 S * 10/2004 Trettin ..... D9/415
D497,800 S * 11/2004 Trettin ..... D9/415
6,854,594 B2 * 2/2005 Vasudeva ..... A47F 5/0861 215/273
7,392,902 B2 * 7/2008 Chang ..... A47F 7/024 206/349
8,336,710 B2 * 12/2012 Chang ..... B25H 3/04 206/349
8,448,787 B1 * 5/2013 Chang ..... B65D 73/0064 206/378
8,864,097 B2 * 10/2014 Wang ..... F16M 13/005 248/314
D729,620 S * 5/2015 Christensen ..... D9/415
9,511,917 B2 * 12/2016 Ou ..... B25H 3/04
10,000,322 B2 * 6/2018 Nowacki ..... B65D 47/147
10,294,000 B2 * 5/2019 Winkler ..... B65D 73/0064
10,453,317 B2 * 10/2019 Lai ..... G08B 13/2434
10,486,876 B2 * 11/2019 Vagnoni ..... B65D 73/0064
D873,655 S * 1/2020 Rosebrook ..... D9/415
11,186,428 B2 * 11/2021 Meyers ..... B65D 73/0035
11,295,636 B2 4/2022 Schiller et al.
11,685,584 B1 * 6/2023 Chen ..... A47F 3/002 206/349
2004/0256530 A1 * 12/2004 Wheeler ..... B65D 73/0064 248/317
2005/0252870 A1 * 11/2005 Roesler ..... B65D 73/0042 211/69
2006/0118449 A1 * 6/2006 Samberg ..... B25H 3/006 206/349
2006/0201836 A1 * 9/2006 Pendergraph ..... B65D 73/0064 206/379
2007/0080086 A1 * 4/2007 Dreps ..... B65D 73/0064 206/495
2008/0210827 A1 * 9/2008 Samelson ..... A47F 5/0823 248/56
2011/0132787 A1 * 6/2011 Bertken ..... B65B 15/00 206/495
2011/0168597 A1 * 7/2011 Titros ..... B65D 73/0064 206/495
2011/0192746 A1 * 8/2011 Chang ..... B65D 25/22 206/379
2012/0031789 A1 * 2/2012 Chang ..... B25H 3/04 206/349
2012/0234709 A1 * 9/2012 Chang ..... B65D 25/108 206/349
2013/0270136 A1 * 10/2013 Pendergraph ..... B65B 47/02 206/349
2013/0313402 A1 * 11/2013 Lin ..... A47F 5/0861 248/686
2014/0290316 A1 * 10/2014 Chen ..... A47F 5/0006 70/61
2015/0114862 A1 * 4/2015 Hu ..... B65D 73/0064 206/349
2015/0114869 A1 * 4/2015 Heidl ..... B65D 73/0021 206/495
2016/0023829 A1 * 1/2016 Pendergraph ..... B65B 5/02 206/349
2016/0029816 A1 * 2/2016 Johns ..... A47F 5/0884 248/214
2017/0174407 A1 * 6/2017 Winkler ..... B25H 3/003
2018/0072475 A1 * 3/2018 Su ..... B65D 73/0064
2018/0354673 A1 * 12/2018 Domingues ..... B31C 3/04
2018/0354693 A1 * 12/2018 Vagnoni ..... B25H 3/003
2020/0184854 A1 6/2020 Schiller et al.
2020/0277117 A1 * 9/2020 Vagnoni ..... B65D 73/0014
2021/0016958 A1 * 1/2021 Meyers ..... B65D 85/20
2022/0165183 A1 5/2022 Schiller et al.
2022/0297865 A1 * 9/2022 Meyers ..... B65B 5/06

* cited by examiner

ARTICLE HANGER, SALES PRODUCTS AND PRODUCTION METHOD

CROSS-REFERENCE TO RELATED APPLICATION

This patent application claims the benefit of European Patent Application No. 22187119.7, filed Jul. 27, 2022, which is incorporated by reference herein.

BACKGROUND OF THE INVENTION

The invention relates to an article hanger for hanging articles on a sales stand, for example. The invention furthermore relates to a sales product and a production method.

Articles, for example tools for mobile machine tools, such as augers, in particular rock augers, chisels, building products, such as screws, dowels, nails, fastening elements, packaged building chemicals or the like, are often hung on sales stands for presentation on the shop floor. To this end, the articles are provided with an article hanger. To this end, the article hanger has a hanging opening, for example in the form of a so-called Eurohole. With the aid of the hanging opening, the article hanger, and therefore the article, can be fastened on a hook of the sales stand, for example.

At construction sites, for example above-ground construction sites or underground construction sites, the articles must be separated from the article hanger before their first use. When unpacking the article, article hangers are often disposed of inappropriately, for example tossed carelessly aside or on the floor. In view of the sheer quantity of such articles at construction sites, this results in a significant environmental burden The object of the present invention, therefore, is to provide an option with which articles, in particular articles for use at construction sites, can be presented on sales stands, wherein environmental risks linked to the packaging of the articles are reduced.

The object is achieved by an article hanger having a receiving region, wherein, by means of the receiving region, a receiving space for receiving an article of at least one article type, for example at least type of tool for a mobile machine tool or at least one type of building product, is formed in the interior of the receiving space, wherein the receiving space is formed from a wound tube and/or at least comprises a wound tube.

To this end, a wound tube can be produced from an, in particular, sheet-like raw material. To this end, the raw material can be wound so that an, in particular, sleeve-like tube is formed.

The invention is based on an idea that wound tubes can be manufactured from an essentially environmentally-friendly material. However, such environmentally-friendly materials, by nature, often do not have adequate mechanical properties for fastening an article thereto. However, a wound tube offers design parameters which enable mechanical properties of the article hanger to be adapted to the respective article to be received in the article hanger. In particular, the rigidity of the wound tube can be adapted, for example, via the thickness and/or via the number of layers, i.e. windings, of the wound tube.

A further idea is furthermore to receive the article in an interior of the wound tube. To this end, the article can be inserted into the wound tube. At least one diameter of the article preferably corresponds to an internal diameter of the wound tube. In this regard, a friction fit and/or a form fit can be produced between the wound tube and the article, at least in certain portions.

Whilst wound tubes have hitherto been used to produce articles such as toilet paper, provision is made for the articles to be received, preferably only partially, in the interior of the wound tube. With suitable dimensions and by selecting suitable design parameters, a friction fit and/or a force fit can be produced between the article hanger and the article to be received.

Internal tests have shown that wound tubes can surprisingly already exhibit strong holding forces as a result of friction force alone.

A particular advantage also consists in the fact that the goods hanger can be separated from the article without a tool. The article can therefore be removed from the receiving space by pulling sharply. An advantage in terms of efficiency can be seen especially at construction sites if, for example, a worker does not have to don and remove gloves or search for a specific tool to separate an article, for example a consumer product, from its article hanger.

Particularly high rigidity and therefore strong holding forces can be achieved if the wound tube is parallel-wound. In this regard, for example, seven, in particular parallel, windings may already be sufficient to achieve holding forces of 10 N or more. An article hanger with such a wound tube can therefore receive articles with a weight of approximately 1 kg or even more in a secure supporting manner.

For example, but not exclusively, if only low holding forces are required, for example for hanging relatively light articles, it is also conceivable that the wound tube is wound diagonally, i.e. similarly to conventional wound tubes for toilet paper or the like. Such a wound tube can therefore be designed as a spiral wound tube. A rock auger or a chisel with a small diameter, for example less than 10 millimeters, for example 6 millimeters, and a length of a few centimeters may have a weight of, for example, less than 100 grams, for example between 35 and 45 g. For such a rock auger or chisel, it is therefore also conceivable to use a diagonally wound tube.

As an environmentally friendly material, the wound tube can be formed from a biodegradable material, in particular a pulp-based material, for example a wood- or grass-containing material, preferably paper and/or paperboard. The material can generally contain pulp. It can also comprise already recycled and/or recyclable material.

In internal tests, an article hanger, at least for heavier articles, for example for articles with a weight of 500 g or more, which also remains securely mounted on the article and can provide the required holding forces on a long-term basis, even under the anticipated difficult transport conditions, has not been successfully produced by simply folding paper or paperboard. However, by using such materials in the form of a wound tube, this has been surprisingly successful.

The article can be arranged on the article hanger in an even more secure manner if a narrowing is formed in the receiving space. To this end, the receiving region can have an inward protrusion. If, for example, the article itself has a narrow point, a particularly stable form fit can be established in a contact region between the narrowing and the narrow point.

So as to be able to fasten the article hanger and therefore the article on conventional sales stands, or the hooks thereof, the article hanger can have a hanging region with a hanging opening.

Articles, for example the above-mentioned tools, can have comparatively small diameters. Since the wound tubes used to produce the article hangers preferably have a similar diameter to these articles, it is preferable if the hanging opening is circular. With larger diameters, however, it is alternatively or additionally conceivable for the hanging opening to comprise an elongated hole. In such cases, the hanging opening can comprise a so-called "Eurohole".

The hanging region can be flattened, at least in one region. To this end, the hanging region may have been compressed, for example, from two opposite sides in this region. A label, for example in the form of an adhesive tab, can then be applied particularly easily in this region.

By selecting one or more design parameters as described above, the receiving region can be designed for receiving an article of at least 0.1 kg, in particular at least 0.5 kg, for example at least 1 kg, in a suspended manner.

Relatively heavy tools and/or consumer products, for example long nails or screws or packs of multiple such consumer products, or tools with a large diameter and/or a long length, for example greater than 30 cm, e.g. a length of at least a 50 cm, can therefore also be hung on the sales stand with the aid of the article hanger, without the articles slipping out of the article hanger and therefore falling off the sales stand, for example. In other words, particularly secure mounting of the articles can be ensured, even when they have a relatively high weight.

The windings of the wound tube can be glued together. In particular, they can be extensively glued. For example, mutually contacting regions of the windings can be glued on at least 50 percent of the common contact surface, in particular on at least 70 percent.

The specific configuration as a wound tube helps to protect the article hanger from external environmental influences, for example high moisture levels, excessively dry conditions, high or low ambient temperatures. In particular, the wound tube can be designed so that it does not swell, or only swells slightly, even with high humidity, for example higher than 80%. Likewise, the wound tube can be designed so that it does not shrink, or only shrinks slight, even in excessively dry conditions.

The glueing of the wound tube can also improve such environmental resistance.

In this regard, in particular by selecting a suitable glue, a sufficiently large glueing surface and/or by selecting a suitable number of layers and wall thickness of the wound tube, the article hanger can be designed to carry articles on a long-term basis, in particular for more than 3 months, and, for example, when the articles have a weight of at least 0.5 kg, in particular at least 1 kg, with continuous humidity of at least 80 percent and/or with continuous humidity of less than 40 percent. Such an article hanger can be used in a wide variety of regions, in particular worldwide or at least only with the exception the polar regions.

Furthermore falling within the scope of the invention is a sales product, comprising an article and an article hanger, which is designed in a manner described above and/or below, wherein the article is at least partially arranged in the receiving region of the article hanger.

To this end, the article can be elongated. It can at least have a portion which has an elongated form. The article can be, for example, cylindrical or at least substantially cylindrical. Substantially cylindrical here is understood to mean that the article has at least one portion which has a cylindrical envelope. This is often the case in tools, for example the above-mentioned augers or chisels with their standardized shanks. For example, the shank can correspond to a standard which is conventionally referred to as "SDS Plus", as "SDS Max" or the like.

The article can have at least one indentation. For example, the shanks according to "SDS Plus" can have a plurality of recesses or notches, which can be regarded as indentations here.

The receiving region of the article hanger can engage in these indentations by means of its narrowing. A particularly stable form fit can therefore be produced between the article and the article hanger.

In view of the large quantities of article hangers and therefore the significant risks to the environment when disposing of them, it is particularly favorable it the article comprises at least one tool for a mobile machine tool, in particular a drilling tool, a chiseling tool, or a grinding tool and/or at least one building product.

Furthermore falling within the scope of the invention is a production method for producing a sales product of the type described above and/or below. The production method here can comprise the following phases:

a) arranging a holding portion of an article in a free end of a wound tube, b) producing a friction fit and/or a form fit between the wound tube and the holding portion.

The friction fit here can already be produced by selecting suitable dimensions of the wound tube in relation to the article to be received therein.

To produce the form fit, the wound tube can be deformed before and/or after the insertion of the holding portion. For example, the wound tube can be pressed-in at least in one region. The narrowing can be produced in a simple manner as a result of the pressing-in.

The holding portion can correspond to a sub-region of the article. In the case of tools mentioned at the outset, the holding portion can correspond, for example, to the shaft or part of the shaft.

To arrange the holding portion in the wound tube, the holding portion can be inserted into the free end of the wound tube.

It is alternatively conceivable to wind raw material for the wound tube around the holding portion and to thereby generate the receiving region and/or the hanging region.

The wound tube can be flattened in one region, for example to generate the flattened hanging region.

A hanging opening can be incorporated in the hanging region. For example, a hole can be punched into the hanging region. The hole can be elliptical, in particular circular.

It is, in particular, conceivable to incorporate the hanging opening in the hanging region, to generate the flattened hanging region and/or to produce the form fit in a single procedure. To this end, preferably when the holding region is already provided in the wound tube, the wound tube is pressed and/or punched from the outside using a molding tool and/or a punching tool.

It is also conceivable to apply a label to the article hanger, for example on the flattened region and/or the receiving region. To this end, a tab can affixed, for example.

Further features and advantages of the invention are derived from the following detailed description of exemplary embodiments of the invention, with reference to the figures of the drawing which shows details essential to the invention, and from the claims. The features shown therein are not necessarily to be understood as true to scale and illustrated in such a manner that the special features according to the invention can be made clearly visible. The various features can be implemented individually in their own right or collectively in any combinations in variants of the invention.

Exemplary embodiments of the invention are illustrated in the schematic drawing and explained in more detail in the following description.

In order to make it easier to understand the invention, the same reference signs are used in each case for identical or functionally equivalent elements in the following description of the figures.

Figure 1:
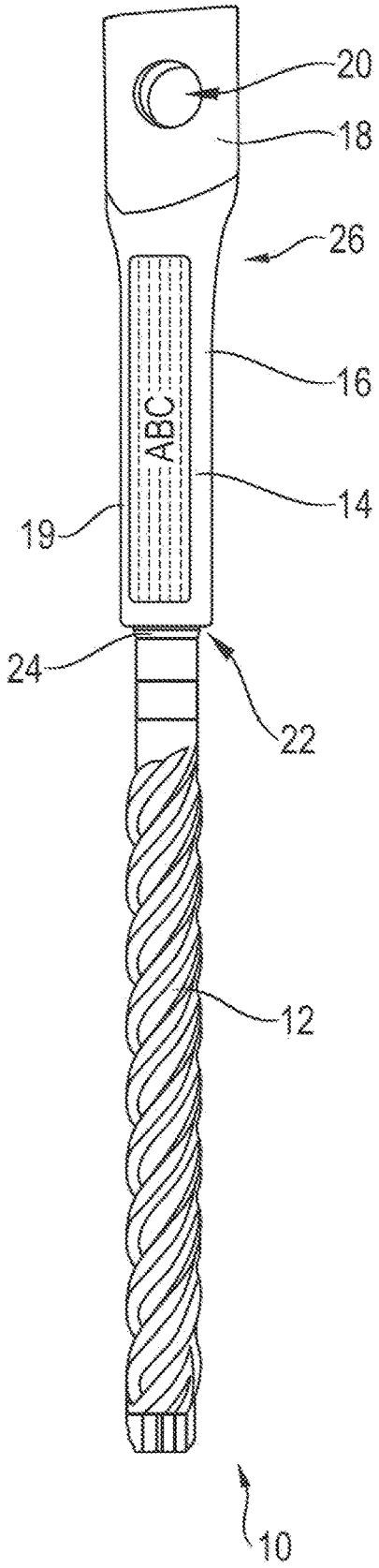
FIG. 1 shows a sales product.

FIG. 1 shows a sales product 10 with an article 12 which is arranged in an article hanger 14. The article 12 is a rock auger. It can be designed for use with a mobile machine tool, in particular a hammer drill.

The article hanger 14 has a receiving region 16 and a hanging region 18.

The receiving region 16 has an at least substantially cylindrical form.

A tab 19 with a label is affixed in the region of the receiving region 16.

The hanging region 18 is flattened at least in one region. It has a receiving opening 20. The receiving opening 20 is elliptical, in particular circular.

The receiving region 16 forms a receiving space 22, in particular at the remaining free end of the article hanger 14.

The article 12, i.e. the rock auger, is received in the receiving space 22 by means of a holding portion 24. The holding portion 24 here can correspond to a shaft of the article 12, i.e. of the rock auger. The shaft can have a form which is conventionally described as "SDS Plus" or as "SDS max". The article 12 can therefore have at least one indentation (not shown in FIG. 1).

The external diameter of the article 12 in the region of its holding portion 24 corresponds at least substantially to an internal diameter of the receiving space 22.

A friction fit is therefore established between the article 12 and the article hanger 14, in particular in the region of its receiving region 16 and, in particular, in the region of the receiving space 22 thereof.

The article hanger 14 is formed from a wound tube 26. The receiving region 16 and the hanging region 18 therefore comprise a wound material.

The wound tube 26 and therefore the wound material is paperboard, in particular a cardboard material. It may be a fully recycled and/or biodegradable cardboard material. The cardboard material, in particular a single layer of the cardboard material, can have a thickness in the range of 0.2 to 0.3 mm, for example 0.27 mm. It can have a residual moisture in the range of 5 to 10 percent. Its grammage can be in the range of 100 to 300 g/m$^2$, for example in the range of 190 to 210 g/m$^2$, in particular 200 g/m$^2$.

The wound tube 26 and therefore the wound material are parallel-wound. The wound tube 26 has seven windings.

Adjacent windings are glued together, in particular glued over their full surface. The glue can be water-soluble. The glue can be based on polyvinyl alcohol and/or polyvinyl acetate, for example. It preferably corresponds to an environmental safety standard. The glue can preferably also be biodegradable.

A biodegradability can correspond to a degradation of at least 80 percent in less than 5 years, in particular in less than 3 years, for example in less than 1 year, in natural surroundings with a Central European climate.

The article hanger 14 is splash-resistant.

Internal tests have shown that the article hanger 14 can at least receive articles 12 with a weight of 0.5 kg in a secure manner.

Figure 2:
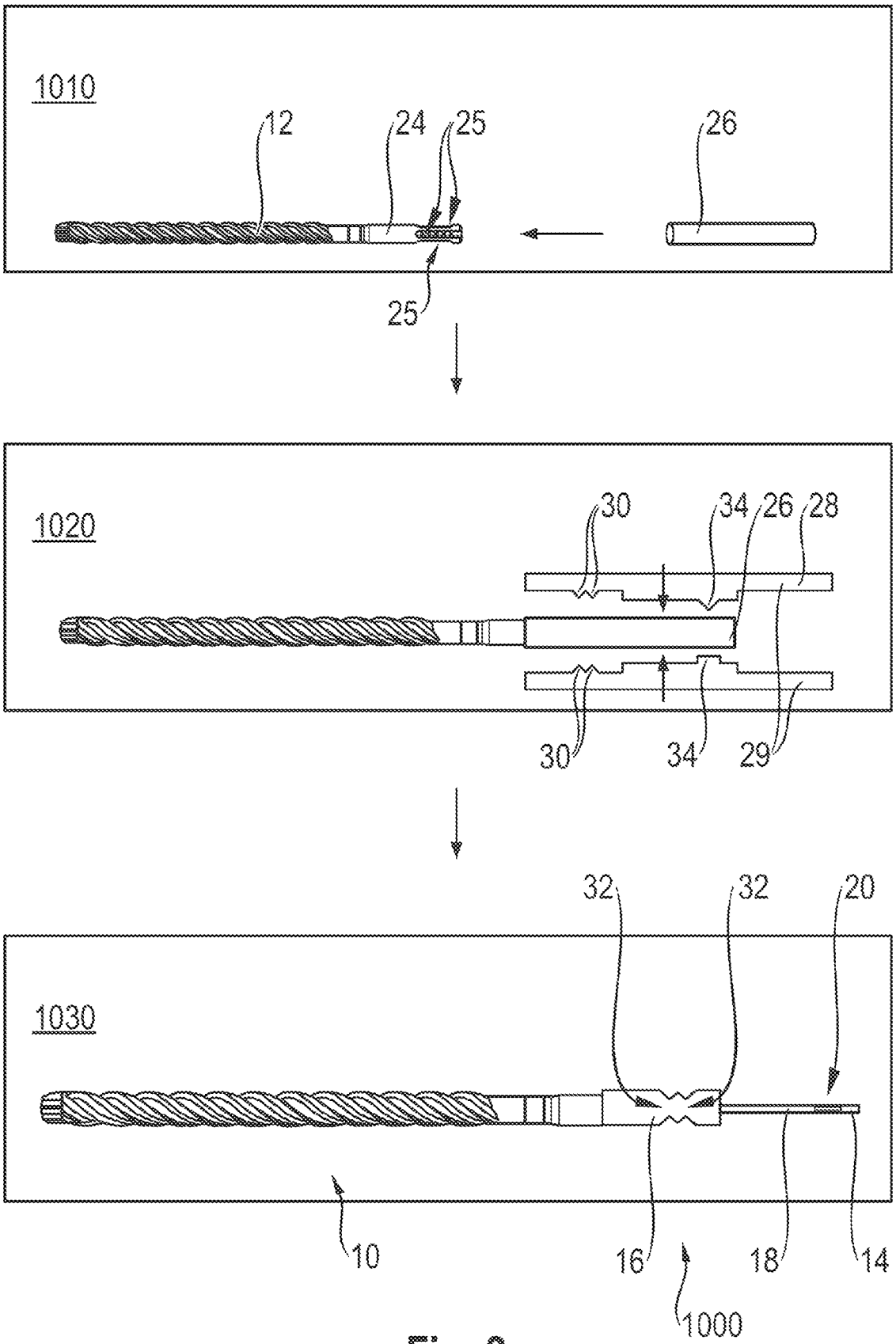
FIG. 2 shows a production method for producing the sales product.

FIG. 2 shows a production method 1000 for producing the sales product 10. To illustrate individual aspects, elements of the sales product 10 and preliminary stages of the sales product 10 are depicted multiple times in FIG. 2 and are not true to scale. Their depiction in FIG. 2 may therefore differ in terms of their enlargement or reduction factors.

The wound tube 26 can be provided in a preparation phase 1010. At this time, the wound tube 26 can still be cylindrical overall. To provide the wound tube 26, an initially flat or rolled raw material, in particular the cardboard material described above, can be parallel-wound and glued.

The wound tube 26 is pushed onto a holding portion 24 of the article 12 to be received—in this case the above-described tool with its shaft, which has a plurality of indentations 25. The holding portion 24 of the article 12 is therefore arranged in the free end of the wound tube 26. This region corresponds to the subsequent receiving region 16 (see FIG. 1) with its receiving space 22 (likewise, see FIG. 1).

At least one internal diameter of the receiving region 16 is preferably selected to correspond to at least one diameter of the holding portion 24, so that, with the arrangement of the holding portion 24 in the receiving region 16, a friction fit is produced between the wound tube 26 and the holding portion 24.

In a following molding phase 1020, the wound tube 26 is molded, in particular pressed, with the aid of a molding tool 28.

To this end, the molding tool 28 can comprise two half shells 29.

The half shells 29 can have projections 30 in the region of the receiving region 16. The projections 30 can be designed to press into the wound tube 26 and to therefore generate an inward protrusion 32 on its inside (as indicated schematically with the aid of arrowheads in FIG. 2).

Prior to generating the protrusions 32, it is also conceivable to align and/or arrange the article 12 such that at least one of the indentations 25 is aligned with at least one of the projections 30, so that, after the pressing procedure, at least one of the generated protrusions 32 engages in the at least one of the indentations 25. To this end, the article 12 can already be aligned and/or arranged accordingly in the preparation phase 1010. Alternatively or additionally, this can also take place during the molding phase 1020.

Therefore, a form fit between the wound tube 26 and the holding portion 24 is produced by pressing.

The molding tool 28 can have at least one punching projection 34 in the region of the hanging region 18. The at least one punching projection 34 can be designed to generate the hanging opening 20 by punching.

After removing the molding tool 28, the sales product 10 can then be removed in a use phase 1030.

It is also conceivable to identify the generated tool hanger 14. For example a tab 19 (see FIG. 1) can be affixed.

The sales product 10 can then be used. For example, it can be hung an a hook of a sales stand (not shown in FIG. 2).

LIST OF REFERENCE SIGNS

10 Sales product
12 Article
14 Article hanger
16 Receiving region

18 Hanging region
19 Tab
20 Receiving opening
22 Receiving space
24 Holding portion
25 Indentation
26 Wound tube
28 Molding tool
29 Half shells
30 Projections
32 Inward protrusion
34 Punching projection
1000 Production method
1010 Preparation phase
1020 Molding phase
1030 Use phase

The invention claimed is:

1. An article hanger having a hanging region having a hanging opening, and receiving region, wherein, by means of the receiving region, a receiving space for receiving an article of at least one article type is formed in the interior of the receiving space, wherein the receiving region is formed from a wound tube and/or comprises a wound tube, wherein the wound tube is formed from a biodegradable material, wherein the hanging region is flattened in at least one region.

2. The article hanger as claimed in claim 1, wherein the wound tube is parallel-wound.

3. The article hanger as claimed in claim 1, wherein the wound tube is formed from paper and/or paperboard.

4. The article hanger as claimed in claim 1, wherein a narrowing of the receiving region is formed in the receiving space.

5. The article hanger as claimed in claim 1, wherein the hanging opening is circular.

6. The article hanger as claimed in claim 1, wherein the receiving region is designed for receiving an article of at least 0.1 kg in a suspended manner.

7. The article hanger of claim 1, wherein the receiving region comprises the wound tube.

8. A sales product comprising an article and an article hanger having a receiving region, wherein, by means of the receiving region, a receiving space for receiving an article of at least one article type is formed in the interior of the receiving space, wherein the receiving region is formed from a wound tube and/or comprises a wound tube, wherein the wound tube is formed from a biodegradable material, wherein the article is arranged at least partially in the receiving region of the article hanger, wherein a narrowing of the receiving region is formed in the receiving space of the article hanger and the article has an indentation in which the narrowing engages.

9. The sales product as claimed in claim 8, wherein the article comprises at least one tool for a mobile machine tool, or at least one building product.

10. The sales product as claimed in claim 9, wherein the article comprises at least one building product.

11. A production method for producing a sales product comprising an article and an article hanger having a receiving region, wherein, by means of the receiving region, a receiving space for receiving an article of at least one article type is formed in the interior of the receiving space, wherein the receiving region is formed from a wound tube and/or comprises a wound tube, wherein the wound tube is formed from a biodegradable material, wherein the article is arranged at least partially in the receiving region of the article hanger, wherein a narrowing of the receiving region is formed in the receiving space of the article hanger and the article has an indentation in which the narrowing engages, the method comprising:

a) arranging a holding portion of the article in a free end of the wound tube, b) producing a friction fit and/or a form fit between the wound tube and the holding portion.

12. The production method as claimed in claim 11, the method including pressing the wound tube at least in one region.

13. The production method as claimed in claim 11, the method including flattening the wound tube in one region.

* * * * *